United States Patent [19]

Brinkerhoff

[11] 4,195,485

[45] Apr. 1, 1980

[54] DISTILLATION/ABSORPTION ENGINE

[76] Inventor: VerDon C. Brinkerhoff, 917 Park Row, Salt Lake City, Utah 84105

[21] Appl. No.: 889,166

[22] Filed: Mar. 23, 1978

[51] Int. Cl.[2] ..... F01K 25/06

[52] U.S. Cl. ..... 60/649; 60/673

[58] Field of Search ..... 60/649, 673

[56] References Cited

U.S. PATENT DOCUMENTS

| | | | |
|---|---|---|---|
| 427,400 | 5/1890 | Campbell | 60/673 |
| 427,401 | 5/1890 | Campbell | 60/673 |
| 1,961,786 | 6/1934 | Roe | 60/649 X |
| 4,009,575 | 3/1977 | Hartman | 60/673 X |

FOREIGN PATENT DOCUMENTS

| | | | |
|---|---|---|---|
| 294882 | 9/1929 | United Kingdom | 60/673 |

*Primary Examiner*—Allen M. Ostrager
*Attorney, Agent, or Firm*—J. Winslow Young; H. Ross Workman; Rick D. Nydegger

[57] ABSTRACT

A distillation/absorption engine including apparatus for utilizing a lower boiling point, working fluid and a higher boiling point, absorption fluid, the absorption fluid having a relatively high degree of absorptivity for the working fluid. The apparatus includes a distillation column for separating the working fluid from the absorption fluid and a condenser/storage system for storage of the separated working fluid which is condensed and stored as a condensate. An absorption reboiler is used to revaporize the condensed working fluid. The revaporized working fluid is superheated in a superheater before producing mechanical energy in a mechanical expansion engine such as a turbine or the like. Thermal energy for the absorption reboiler is obtained from the heat of absorption generated by absorbing with the absorption fluid the spent working fluid from the mechanical expansion engine. Absorption of the spent working fluid also lowers the backpressure for improved efficiencies. Thermal energy for the superheater is provided by hot absorption fluid directly from the base of the distillation column. Surplus absorption fluid is stored under pressure in a pressurized storage vessel with pressure for the pressurized storage vessel being supplied by vaporized working fluid.

24 Claims, 5 Drawing Figures

DISTILLATION/ABSORPTION ENGINE

BACKGROUND

1. Field of the Invention

This invention relates to mechanical expansion engines for producing mechanical energy from a thermally pressurized vapor and, more particularly, to a distillation/absorption engine which uses both a working fluid and an absorption fluid having a relatively high degree of absorptivity for the working fluid.

2. The Prior Art

High temperature and pressure steam systems are widely employed for power generation. The efficiency of such systems, at 1,000 PSIA and 1,400° C., may approach about 39–40% compared to typical 13–15% efficiency for conventional internal combustion engines. However, these power generation systems generally utilize an open cycle system involving cooling towers and the like.

Many unsuccessful attempts have been made to close the steam cycle and to adapt the closed cycle steam system for automotive applications. However, the relatively large condensors required for the relatively large specific volume of steam at the required low pressures, makes the conventional steam system unfeasible as a replacement engine for an automotive vehicle. These prior art external combustion engines are generally inefficient since they usually incorporate the single working fluid within a closed cycle and limit the condensation or backpressure to those pressures created by an external cooling medium (usually air) condensing the single fluid within the closed condensor. Accordingly, the relatively low internal fluid pressures and low heat capacity of the external heat sink (air) for the single working fluid requires correspondingly large cooling components which are necessary to contain and condense the large volume of fluids required for the closed cycle system.

In view of the foregoing, it would be an advancement in the art to provide a novel distillation/absorption engine utilizing an absorption fluid for the working fluid to accommodate higher working fluid pressures and lower backpressures in the system. It would also be an advancement in the art to provide a dual fluid system whereby heat of absorption is utilized for revaporizing the working fluid, the working fluid having been condensed to provide a smaller volume reservoir of condensed working fluid. Such an invention is disclosed and claimed herein.

BRIEF SUMMARY AND OBJECTS OF THE INVENTION

The present invention relates to a novel apparatus and method whereby a combination working fluid and absorption fluid are utilized in a thermal expansion system to more efficiently produce mechanical energy from thermal energy. Thermal energy in a distillation column separates the working fluid from the absorption fluid. The vaporized working fluid is subsequently condensed and stored as a liquid in a working fluid storage reservoir. An absorption reboiler revaporizes the condensed working fluid with thermal energy produced as heat of absorption. The absorption fluid is also used as a heat transfer medium for superheating the revaporized working fluid. The superheated, working fluid vapor is directed to a mechanical expansion engine to produce mechanical energy and is thereafter absorbed by the absorption fluid to produce a relatively low backpressure and the thermal energy from the heat of absorption.

It is, therefore, a primary object of this invention to provide improvements in external combustion engine apparatus.

Another object of this invention is to provide improvements in the method of producing mechanical energy from thermal energy.

Another object of this invention is to provide an improved heat engine apparatus whereby a working fluid and absorption fluid combination is utilized in the apparatus.

Another object of this invention is to provide an improved external combustion engine apparatus whereby the absorption fluid is used as a heat exchange medium for superheating the working fluid in a superheater.

Another object of this invention is to provide an improved apparatus for utilizing the heat of absorption for revaporizing condensed working fluid.

Another object of this invention is to provide an improved apparatus for distilling an absorption solution to produce a vaporized working fluid and an absorption fluid.

Another object of this invention is to provide improvements in apparatus for converting thermal energy to mechanical energy by lowering the backpressure of the system by absorbing the working fluid with an absorption fluid.

Another object of this invention is to provide a high pressure condenser as an external heat sink.

Another object of this invention is to provide a dual fluid system wherein the working fluid passes through four phase changes in a closed system.

These and other objects and features of the present invention will become more fully apparent from the following description and appended claims taken in conjunction with the accompanying drawing.

DETAILED DESCRIPTION OF THE PREFERRED EMBODIMENTS

Figure 1:
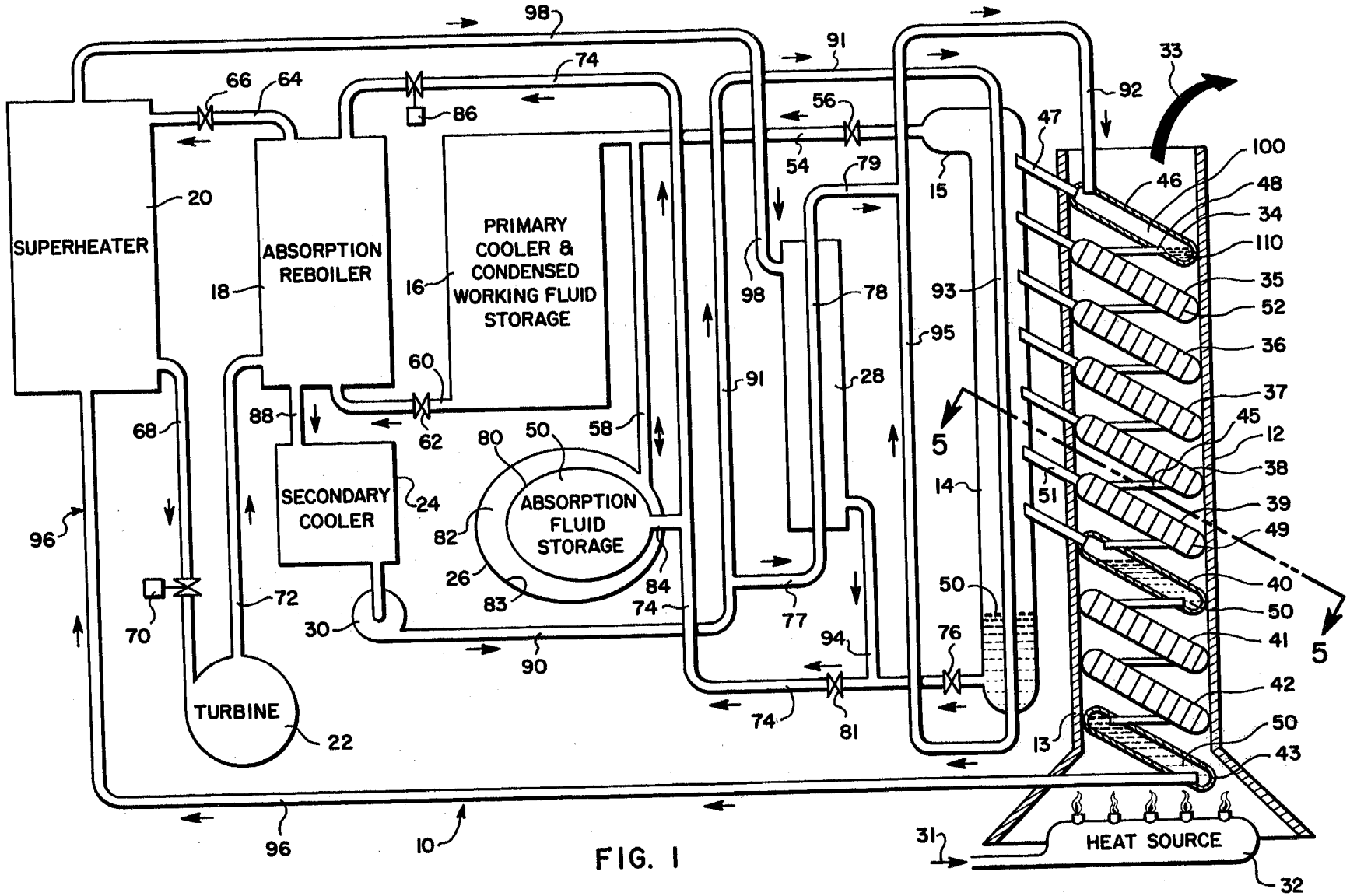
FIG. 1 is a flow diagram of the apparatus of the present invention with portions thereof shown schematically and in cross-section for ease of presentation.

The invention is best understood by reference to the drawing wherein like parts are designated with like numerals throughout.

GENERAL DISCUSSION

As defined herein, the term "working fluid"is that fluid which, as a vapor, passes through the mechanical expansion device to produce a work output. The term "absorbent or absorption fluid"is a term for the fluid which has a relatively high degree of absorptivity for the working fluid and, preferentially, is not volatilized by the distillation process. The term "absorption solution"is a term that is given to the mixture of working fluid and absorption fluid. Clearly, some absorption fluid remains in the working fluid throughout the process and, correspondingly, some working fluid remains in the absorption fluid. However, for purposes of simplicity, it will be generally assumed that a complete separation is made between the working fluid and the absorption fluid in the distillation and rectifier columns.

One of the oldest refrigeration devices was designed on the absorption principle, using heat directly to dry the refrigerant out of the absorbing medium and into the condenser. The absorbent may be liquid or solid, and the operation may be continuous or intermittent. If operation is continuous, a liquid pump may be used or, with the aid of an inert gas, circulation may be made possible by means of a percolator action as well as by the reduction of the density on account of the rise of temperature due to the heating. The machine may have only two fluids, the solvent (absorption fluid) and the refrigerant (working fluid) , or, again, it may have as many as four or five.

Additional background information regarding various absorbent-refrigerant mixture can be found in the *ASHRAE Journal* of May 1976 in an article entitled "Effect of Operating Variables on COP for Certain Absorbent-Refrigerant Mixtures." See also "Refrigerants and Absorbents," *Refrigerating Engineering,* Vol. 48, No. 2, August 1944, and the sequel thereto. Additionally, various charts and diagrams are extant relative to the properties of numerous working fluids and absorption fluids suitable for use in the apparatus and method of this invention.

Referring now more particularly to FIG. 1, the distillation/absorption engine apparatus of this invention is shown generally at 10 and includes a distillation column or distiller 12, a rectifier column 14, a primary cooler and condensed working fluid storage 16, an absorption reboiler 18, a superheater 20, and an expansion engine shown herein as a turbine 22. Included within the apparatus are a secondary cooler 24, an absorption fluid storage 26, and a countercurrent heat exchanger 28. Peripheral equipment include a pump 30, a heat source 32, and valves 56, 62, 66, 70, 76, 81, and 86.

Figure 5:
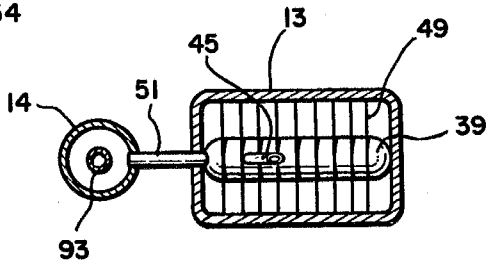
FIG. 5 is a cross-section taken along lines 5—5 of FIG. 1.

Distiller 12 is configurated as a hollow column having a rectangular cross-sectional shell 13 with a plurality of distillation tubes 34–43 serially arrayed therein. With reference also to FIG. 5, each of distillation tubes 34–43 are configurated as cylindrical tubes transecting the axis of shell 13 as shown particularly with respect to distillation tube 39 (FIG. 5). Each of distillation tubes 34–43 include a plurality of heat exchange fins 49 (FIG. 5) which transect shell 13 at an angle to the axis of distiller 12. Fins 49 provide an angled passageway adjacent each of distillation tubes 34–43 to provide thorough mixing of the hot flue gases 33 produced by heat source 32. In particular, each set of fins 49 direct the hot flue gases 33 toward the right or the pool of absorption solution 110 in each of distillation tubes 34–43. In this manner, the thermal energy of hot flue gases 33 is concentrated where it is most required.

Additionally, each of distillation tubes 34–43 are canted in distiller 12 with vapor tubes 47 and 51 as shown on distillation tubes 34 and 39, respectively, which allow the escape of working fluid vapor 100 into rectifier column 14. The lower distillation tubes 34–43 and, more particularly, distillation tubes 41–43, serve as a collection reservoir for residue absorption solution 110, if any, and absorption fluid 50.

In operation of distiller 12, incoming absorption solution 110 is received from an inlet 92 into the cylindrical shell 46 of distillation tube 34 where working fluid vapor 100 is generated by absorption of heat energy from hot flue gases 33. The working fluid vapor 100 passes through vapor tube 47 into rectifier column 14. Residue absorption solution 110 passes through a conduit 48 into the next succeeding distillation tube 35 where the distillation/separation process continues.

Additional separation between the absorption fluid 50 and working fluid vapor 100 is achieved in the rectifier column 14 as will be discussed more fully hereinafter. Working fluid vapor 100, under pressure, passes through a conduit 54 and control valve 56 into the primary cooler and condensed working fluid storage 16. The configuration and operation of primary cooler and condensed working fluid storage 16 will also be discussed more fully hereinafter with respect to the apparatus illustrated in FIG. 2.

The working fluid vapor 100 is condensed into a condensed working fluid 102 (FIG. 2) and stored in the primary cooler and condensed working fluid storage 16 until metered by valve 62 into the absorption reboiler 18. Working fluid 102 is revaporized in absorption reboiler 18 to produce working fluid vapor 100 (FIG. 2), the working fluid vapor 100 being directed by a through control valve 66 into superheater 20. The configuration and operation of superheater 20 will be discussed more fully hereinafter in the discussion of FIG. 3.

Superheated working fluid vapor 100 is directed through a conduit 68 and control valve 70 into the expansion engine or turbine 22 where the thermal energy of working fluid vapor 100 is converted to mechanical energy by turbine 22. Exhausted working fluid vapor 100 from turbine 22 is directed by conduit 72 into absorption reboiler 18 where it is absorbed by absorption fluid 50 introduced through conduit 74 and control valve 86. It is the heat of absorption developed as a result of this absorption process which is used to revaporize condensed working fluid 102 (FIG. 2) to produce working fluid vapor 100.

The combination of working fluid vapor 100 absorbed into absorption fluid 50 forms the absorption solution 110 (FIG. 2) which is directed through a conduit 88 to a secondary cooler 24. Pump 30 pumps the absorption solution 110 from secondary cooler 24 through conduit 90 and heat exchanger 28 and rectifier 14 for additional heat exchange prior to introduction into distiller 12. In particular, a portion of the fluid stream of absorption solution 110 is split between conduits 77 and 91, conduit 77 passing through heat exchange column 78 in the countercurrent heat exchanger 28. Absorption solution passing through conduit 91 is directed in heat exchange relationship through heat exchange tube 93 in rectifier column 14. Thereafter, the absorption solution passes through conduit 95, joining the other portion of absorption solution in conduit 79, and is introduced into distiller 12 through inlet 92.

Rectifier column 14 is configurated as a hollow, vertically oriented, cylindrical column having the axial heat exchange tube 93 therein and includes inlets for vapor tubes from each of the distillation tubes 34–40 as shown at vapor tube 47 for distillation tube 34 and vapor tube 51 for distillation tube 39. Rectifier column 14 serves as a final separation between absorption fluid 50 and working fluid vapor 100. In particular, through heat exchange with heat exchange tube 93, condensation of absorption fluid 50 occurs resulting in a pool of absorption fluid 50 in the bottom of rectifier column 14. An upper plenum 15 on rectifier column 14 is in direct fluid communication with a conduit 54 through a valve 56 to control the flow of working fluid vapor 100 from rectifier column 14 into the primary cooler and condensed working fluid storage 16.

A side conduit 58 provides fluid communication for the working fluid vapor 100 from conduit 54 to accommodate the pressurized working fluid vapor 100 serving as a pressurizing medium for the absorption fluid storage reservoir 26. The absorption fluid storage reservoir 26 is configurated with a rigid outer shell 83 and a flexible storage bladder 80. Upon increased pressure in absorption fluid 50, as controller by oneway valve 81, storage bladder 80 is expanded to accommodate receipt of additional absorption fluid 50. Working fluid vapor 100, under pressure through conduit 58, enters the space 82 between rigid shell 83 and storage bladder 80 to thereby pressurize the absorption fluid 50 in the storage bladder 80. The pressurized absorption fluid 50 is directed through a conduit 84 into conduit 74.

Figure 2:
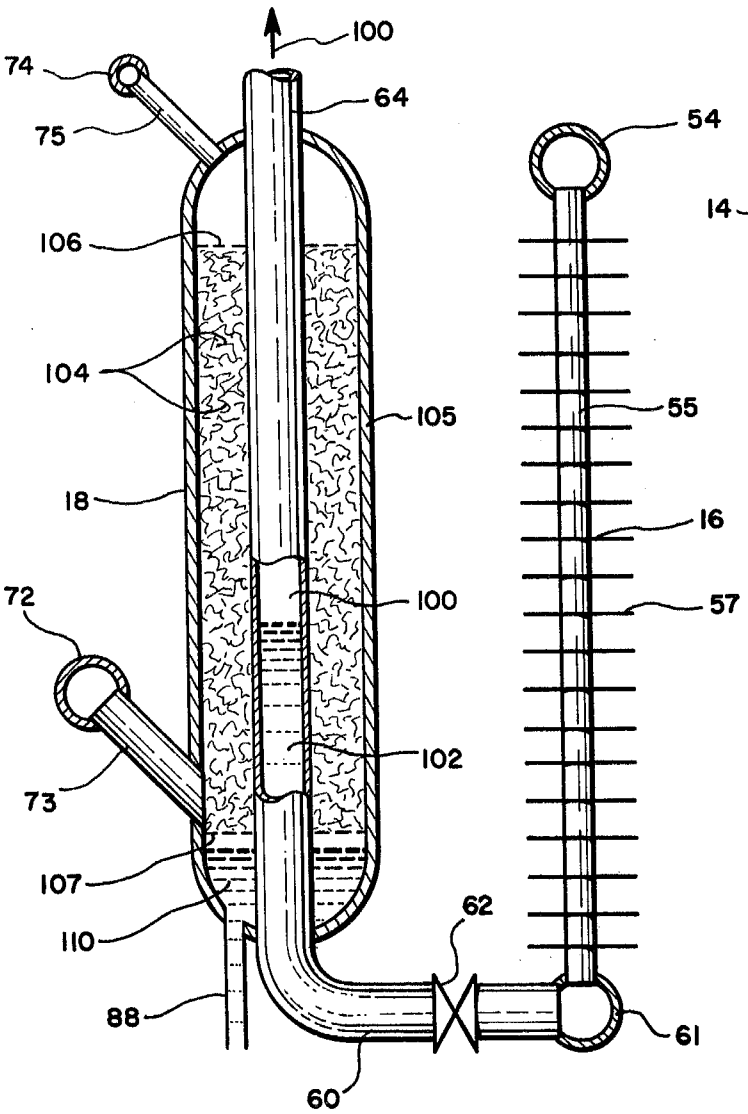
FIG. 2 is a partial cross-section of the absorption reboiler and primary cooler and condensed working fluid storage apparatus.

Referring now more particularly to FIG. 2, primary cooler and condensed working fluid storage 16 is shown in conjunction with absorption reboiler 18. In particular, primary cooler and condensed working fluid storage 16 is configurated as a finned-tube heat exchanger including a plurality of vertically oriented storage tubes 55 having a plurality of horizontal heat dissipation fins 57 mounted thereto in heat exchange relationship. Primary cooler and condensed working fluid storage 16 serves as a high pressure condenser for working fluid vapor 100 and thereby provides an external heat sink operating at high pressure. Where necesary, a pump (not shown) may be included to develop the desired high pressure and may be substituted for valve 56.

The vertical storage tubes 55 are interconnected between an inlet header 54 and an outlet header 61. Inlet header 54 is an extension of inlet conduit 54 and provides a fluid communication for working fluid vapor 100 which is directed downwardly into the plurality of storage tubes 55. In the storage tubes 55, thermal energy is removed from vaporized working fluid 100 through dissipation by fins 57 to accommodate the condensation of working fluid 100 to condensed working fluid 102. The reduction in volume of working fluid vapor 100 in changing from a vapor to condensed working fluid 102 is accommodated by the significantly reduced overall volume of storage tubes 55. Valve 62 serves as a control valve for directing condensed working fluid from outlet header 61 through conduit 60 into the absorption reboiler 18.

The condensation of working fluid vapor 100 provides an energy storage reservoir to accommodate intermittent operation of distiller 12 by providing a reservoir of working fluid which may be readily revaporized in absorption reboiler 18 by the heat of absorption generated therein. This energy storage feature is particularly advantageous where heat source 32 is provided from a solar concentrator (not shown) to thereby accommodate operation during periods when solar energy is unavailable.

Absorption reboiler 18 is configurated as a vertical, hollow column 105 having an axial boiler tube 64 in spaced relationship therein. The annular space between column 105 and boiler tube 64 is filled with a suitable backing 104. Packing 104 is restrained between upper and lower packing screens 106 and 107, respectively.

The function of the absorption reboiler 18 is to (1) utilize the heat of absorption between working fluid 100 and absorption fluid 50 to produce an absorption solution 110 and thermal energy from the heat of absorption, and (2) increase the pressure gradient across turbine 22 since the lowest pressure in the system of this invention is developed in absorption reboiler 18 when exhausted working fluid vapor 100 from turbine 22 is absorbed by absorption fluid 50 In particular, exhausted working fluid and vapor 100 which has been exhausted from turbine 22 is directed through conduits 72 and 73 into absorption reboiler 18. The exhausted working fluid and vapor 100 is introduced adjacent the bottom of absorption reboiler 18 and rises through packing 104 in countercurrent flow with a downwardly flowing absorption fluid 50 introduced through conduits 74 and 75. Packing 104 provides an enlarged surface area for efficient contact between absorption fluid 50 and working fluid 100. Packing 104 is, preferentially, fabricated from a suitable material such as stainless steel or the like to provide a more efficient thermal contact with boiler tube 64. Accordingly, the heat of absorption released by the reaction between absorption fluid 50 and working fluid 100 volatilizes working fluid liquid 102 into working fluid vapor 100. The resulting absorption solution 110 is removed from absorption reboiler 18 through conduit 88 and is passed through secondary cooler 24 before being pumped by pump 30 back into the distillation apparatus of distiller 12.

Figure 3:
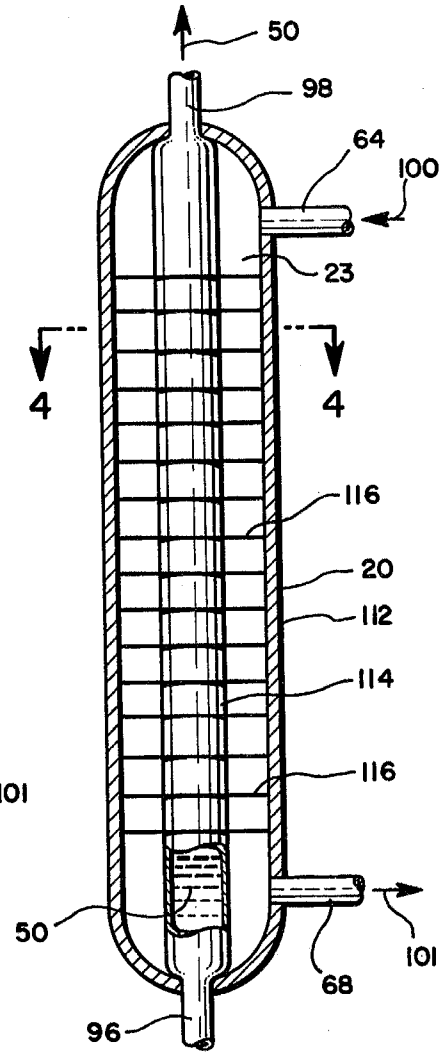
FIG. 3 is a partial cross-section of the super-heater apparatus.
Figure 4:
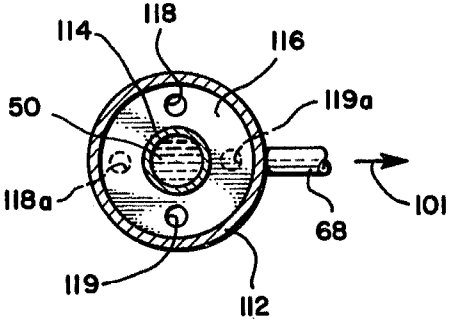
FIG. 4 is a cross-section taken along lines 4—4 of FIG. 3.

Referring now more particularly to FIGS. 3 and 4, superheater 20 includes a cylinderical shell 21 and an axial, diametrally enlarged heat exchange tube 114 mounted therein. The annular space 23 between heat exchange tube 114 and cylindrical shell 112 is transected by a plurality of horizontally spaced discs 116. With particular reference to FIG. 4, each of discs 116 is configurated as a circular disc completely transecting the annular space between heat exchange tube 14 and cylindrical shell 112 with the exception of a pair of diametrally opposed apertures 118 and 119. The next succeeding disc thereunder is rotated 90° so as to place the apertures therein, shown herein in broken lines as apertures 118*a* and 119*a*, at the 90° position from apertures 118 and 119, respectively. In this orientation, working fluid vapor 100 entering through conduit 64 passes through each succeeding disc 116 with its respective, 90° offset apertures 118 and 119, to thereby impart a convoluted path to the working fluid vapor 100. Accordingly, an intimate heat exchange relationship is provided between the hot, absorption fluid 50 in heat exchange tube 114 and working fluid vapor 100 so that the working fluid vapor 100 exits into conduit 68 as superheated working fluid vapor 101.

Discs 116 may also serve as reinforcement members for shell 112 by being welded to the inside surface thereof. Accordingly, savings can be realized by lowering the thickness involved in the fabrication of superheater 20 while achieving the same structural integrity.

Hot absorption fluid 50 for superheater 20 is obtained directly from the bottom of distiller 12 through conduit 96 and is discharged as absorption fluid 50 through conduit 98. The absorption fluid 50 then passes in heat exchange relationship through countercurrent heat exchanger 28 prior to being directed to absorption reboiler 18.

It should, of course, be obvious to those skilled in the art that suitable insulation is provided throughout the apparatus of absorption/distillation engine 10 to thereby reduce heat losses and increase efficiency. However, such insulation is not illustrated herein in order to more clearly set forth the various components and to simplify the drawing.

Furthermore, it will be obvious to those skilled in the art that the various valves may be, selectively, configurated as control valves or check valves to suitably control the flow rate and direction of the fluids in the respective conduits as indicated by the directional arrows located at various positions throughout FIG. 1. Additionally, valve 62 and, where determined appropriate, other valves may be replaced with pumps to further control the flow of fluids.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by United States Letters Patent is:

1. A closed-cycle mechanical energy generating apparatus comprising:
   - a first fluid having a first, lower boiling point;
   - a second fluid having a second, higher boiling point, the second fluid having a relatively high degree of absorptivity for the first fluid;
   - distillation means for separating the first fluid from the second fluid by selectively vaporizing the first fluid with heat from a heat source;
   - condenser means downstream of the distillation means, the vaporized first fluid being condensed in the condenser means;
   - reboiler means downstream of the condenser means, the reboiler means revaporizing the condensed first fluid;
   - mechanical expansion engine means for producing mechanical energy from the vaporized first fluid; and
   - absorption means downstream of the mechanical expansion engine means for absorbing the vaporized first fluid with the second fluid prior to returning the first and second fluids to the distillation means.

2. The apparatus defined in claim 1 wherein the condenser means comprises a storage means for storing said condensed first fluid.

3. The apparatus defined in claim 1, wherein the reboiler means comprises the absorption means whereby the condensed first fluid is vaporized by heat of absorption generated in said absorption means.

4. The apparatus defined in claim 1 wherein the apparatus further comprises a superheater means and the vaporized first fluid is superheated in the superheater means.

5. The apparatus defined in claim 4 wherein the superheater means comprises a heat exchanger means interconnected with the distillation means so that thermal energy for superheating the vaporized first fluid is supplied by separated second fluid from said distillation means.

6. The apparatus defined in claim 5 wherein said superheater means comprises an enclosed, cylindrical vessel having an axial conduit for said second fluid in spaced relationship to the vessel and a plurality spaced discs transversely transecting the annular space between the conduit and the vessel wall, each disc having at least one opening therethrough in offset relationship from each adjacent disc, the vessel having opposed inlet and outlet means for the vaporized first fluid to pass the vaporized first fluid through the annular space as directed by the openings in the discs.

7. The apparatus defined in claim 1 wherein the apparatus further comprises a storage means comprising a pressurized storage vessel whereby a reserved quantity of second fluid is stored in the pressurized storage vessel, the pressurized storage vessel being pressurized by vaporized first fluid.

8. The apparatus defined in claim 1 wherein said distillation means further comprises a rectifier means to separate second fluid carried over with the vaporized first fluid from the distillation means.

9. The apparatus defined in claim 8 wherein the rectifier means further comprises heat exchange means for absorbing heat from residual second fluid vapors carried over with said vaporized first fluid to condense the second fluid vapors, the heat exchange medium for the heat exchange means being provided by combined first and second fluids from the absorption means.

10. The apparatus defined in claim 8 wherein said distillation means comprises a hollow column having a heat source adjacent the bottom of the column and a plurality of distillation tubes serially disposed in spaced relationship in the column, each distillation tube comprising an enlarged vaporization tube having a slanted orientation with a vapor outlet adjacent the upper end and a fluid outlet adjacent the lower end, the vapor outlet being in communication with the rectifier means and the fluid outlet in communication with the upper portion of the next downwardly succeeding distillation tube in the column.

11. The apparatus defined in claim 10 wherein at least one of the lowest distillation tubes is configurated without a vapor outlet to thereby serve as a heater for the second fluid.

12. The apparatus defined in claim 10 wherein the distillation tubes are each configurated with a plurality of fins oriented perpendicularly to the axis of distillation tube and transect the space between the distillation tube and the column thereby forming a zigzag pathway for heat from the heat source for improved heat absorption by the fluids in the distillation tubes.

13. The apparatus defined in claim 1 wherein the absorption means comprises the reboiler means and the reboiler means is configurated as a cylindrical column having an axial vaporization tube for the first fluid and a surrounding annular space having an inlet for first fluid from the mechanical expansion engine means, an inlet for second fluid and a packing material for improved contact between the first fluid and the second fluid.

14. The apparatus defined in claim 13 wherein the apparatus further comprises heat exchange means for heating the second fluid prior to introducing the second fluid into the reboiler means.

15. A closed cycle, dual fluid mechanical energy generating apparatus comprising:
   - a first fluid having a first, lower boiling point;
   - a second fluid having a second, higher boiling point, the second fluid having a relatively high degree of absorptivity for the first fluid;

distillation means for separating the first fluid from the second fluid by selectively vaporizing the first fluid with heat from a heat source;

condensation means for condensing the vaporized first fluid from the distillation means;

vaporization means for vaporizing the condensed first fluid from the distillation means;

superheat means for superheating the vaporized first fluid from the vaporization means; and mechanical expansion engine means for producing mechanical energy from the heat energy of the superheated, vaporized first fluid from the superheat means.

16. The apparatus defined in claim 15 wherein the distillation means further comprises rectifier means for removing second fluid vapors from the vaporized first fluid.

17. The apparatus defined in claim 15 wherein the vaporization means comprises an absorption reboiler wherein heat for the vaporization of the first fluid is obtained from heat of absorption produced by absorbing vaporized first fluid with second fluid.

18. The apparatus defined in claim 17 wherein the vaporized first fluid absorbed by the second fluid is obtained downstream of the mechanical expansion engine means.

19. The apparatus defined in claim 15 wherein the superheat means comprises a heat exchanger for absorbing heat from second fluid from the distillation means with the vaporized first fluid from the vaporization means.

20. A method for converting thermal energy to mechanical energy comprising:

vaporizing a first fluid having a lower boiling point by the absorption of thermal energy in a distillation means while maintaining a second fluid having a higher boiling point as a liquid;

storing the first fluid by condensing the vaporized first fluid;

revaporizing the condensed first fluid with thermal energy produced as heat of absorption produced upon absorbing the first fluid with the second fluid;

driving a mechanical expansion engine means with the vaporized first fluid thereby converting said thermal energy to mechanical energy; and absorbing the vaporized first fluid downstream of the mechanical expansion engine means with the second fluid prior to returning the combined first and second fluids to the distillation means while utilizing thermal energy from the heat of absorption in the revaporizing step.

21. The method defined in claim 20 wherein the revaporizing step includes a subsequent superheating step wherein the revaporized first fluid is superheated in a superheater.

22. The method defined in claim 21 wherein the superheating step further includes directing said second fluid from said distillation means to said superheater.

23. The method defined in claim 20 wherein condensing step comprises condensing the first fluid at a relatively high pressure thereby providing a high pressure external heat sink.

24. The method defined in claim 20 wherein the revaporizing step includes providing the heat of absorption from the absorbing step and thereby providing a greater pressure gradient across the mechanical expansion engine.

* * * * *